United States Patent [19]

Ditges

[11] 4,194,541

[45] Mar. 25, 1980

[54] WIRE STRAIGHTENING APPARATUS HAVING A HYDRAULICALLY DRIVEN WIRE FEED

[75] Inventor: Günter Ditges, Cologne, Fed. Rep. of Germany

[73] Assignee: Myer, Roth & Pastor Machinenfabrik GmbH, Cologne, Fed. Rep. of Germany

[21] Appl. No.: 916,835

[22] Filed: Jun. 19, 1978

[30] Foreign Application Priority Data

Jul. 18, 1977 [DE] Fed. Rep. of Germany ..... 2732402

[51] Int. Cl.[2] ..... B21E 1/02

[52] U.S. Cl. ..... 140/147; 72/79; 72/465

[58] Field of Search ..... 140/139, 140, 147; 72/28, 79, 160, 465; 226/108, 111, 188

[56] References Cited

U.S. PATENT DOCUMENTS 3,338,493 8/1967 Schiffer ..... 226/111

3,854,318 12/1974 Korpeinen ..... 72/465

FOREIGN PATENT DOCUMENTS 1906651 8/1970 Fed. Rep. of Germany ..... 140/147

*Primary Examiner*—Lowell A. Larson

*Attorney, Agent, or Firm*—Spencer & Kaye

[57] ABSTRACT

A wire straightening apparatus includes a machine stand; a wire straightening device; a mounting for securing the wire straightening device to the stand; an inlet roller pair and an outlet roller pair; a mounting for securing the inlet roller pair and the outlet roller pair to the stand adjacent opposite sides of the wire straightening device for feeding a wire therethrough; and a drive for rotating the roller pairs. The drive comprises a first constant-volume hydraulic motor connected to at least one of the rollers of the inlet roller pair; a second constant-volume hydraulic motor connected to at least one of the rollers of the outlet roller pair; and an arrangement for supplying hydraulic medium under pressure to the motors.

10 Claims, 8 Drawing Figures

FIG. 4
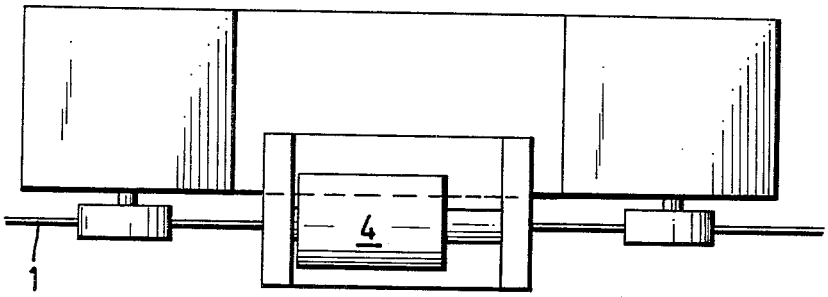
FIG. 5a
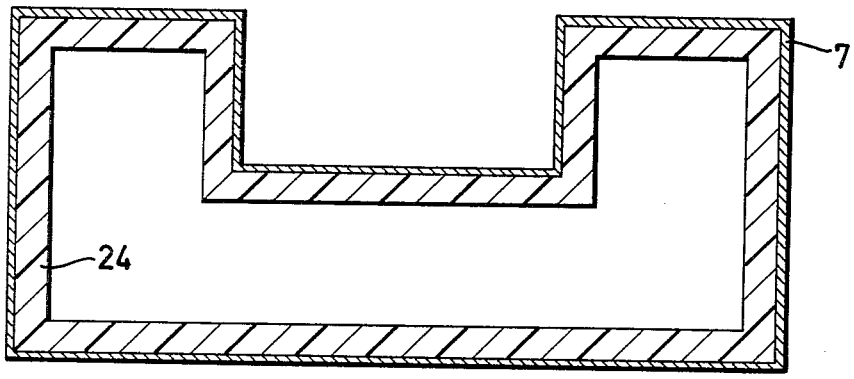
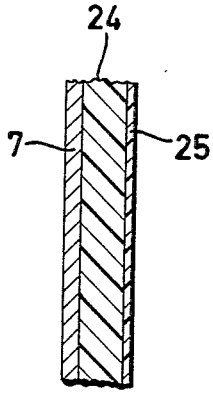
FIG. 5b

WIRE STRAIGHTENING APPARATUS HAVING A HYDRAULICALLY DRIVEN WIRE FEED

BACKGROUND OF THE INVENTION

This invention relates to a wire straightening apparatus having a machine stand which supports a driven inlet roller pair, a wire straightening device and a driven outlet roller pair.

One of the problems involved in wire straightening apparatuses is to drive the inlet and outlet roller pairs synchronously in order to prevent slippage between the wire and the roller pairs, since such a slippage would damage the wire surface. If, for example, the wire is subsequently utilized for making chains, such a surface damage would adversely affect the quality of the chain. A positively coordinated run of the inlet roller pair and the outlet roller pair has been heretofore effected by gear drives which are very expensive since, because of the interposed wire straightening device, the inlet roller pair and the outlet roller pair necessarily have to be arranged at a certain distance from one another.

It has been a further difficulty in conventional wire straightening apparatuses to provide an economical adjustable wire feed in the straightening machine for varying the speed of the throughgoing wire. It is a further disadvantage of conventional wire straightening apparatuses that they operate with significant noise which, with the presently available means, could be reduced only in an insufficient manner.

SUMMARY OF THE INVENTION

It is an object of the invention to provide an improved wire straightening apparatus in which a better and operationally more reliable wire feed is ensured and, at the same time, the noise emission of the apparatus is significantly reduced.

This object and others to become apparent as the specification progresses, are accomplished by the invention, according to which, briefly stated, the wire straightening apparatus includes a machine stand; a wire straightening device; a mounting for securing the wire straightening device to the stand; an inlet roller pair and an outlet roller pair; a mounting for securing the inlet roller pair and the outlet roller pair to the stand adjacent opposite sides of the wire straightening device for feeding a wire therethrough; and a drive for rotating the roller pairs. The drive comprises a first constant-volume hydraulic motor connected to at least one of the rollers of the inlet roller pair; a second constant-volume hydraulic motor connected to at least one of the rollers of the outlet roller pair; and an arrangement for supplying hydraulic medium under pressure to the motors.

The invention provides for a particularly compact and operationally reliable construction wherein the known properties of constant-volume hydraulic motors can be advantageously utilized. Due to the constant rate of volume consumption, these motors can be regulated at constant torque within a relatively large rpm range. Since such motors can also be used in series connection, a synchronous run of the inlet and outlet roller pairs may be effected in a simple manner. The distance between the two roller pairs is of no significance, since merely a hydraulic conduit has to be provided between the two motors for transmitting the hydraulic medium.

According to an advantageous feature of the invention, the driven roller of the respective roller pairs is directly affixed to the drive shaft of the associated hydraulic motor.

In accordance with a further feature of the invention, the conventional straightening rotor of the straightening device is driven by a separate, constant-volume hydraulic motor.

In accordance with another advantageous feature of the invention, motors designed according to the gear pump principle are used as the constant-volume hydraulic motors.

According to a further feature of the invention, the inlet and outlet roller pairs as well as the wire straightening device are each supported on a separate support block which is elastically mounted on the machine stand. This arrangement prevents a transmission of the vibrations generated by the rollers and, because of unavoidable imbalances, by the straightening rotor. Such vibrations tend to cause resonance phenomena involving other components of the machine stand thus resulting in a significant noise emission. It is of particular advantage to support the support block of the straightening rotor in relation to its rpm in a "soft" manner so that the vibrations generated by imbalances during the normal operational rpm's are, in relation to the spring mass system formed by the rotor with its support block and the elastic support, in the "beyond-critical" zone. This arrangement too, provides for a significant noise suppression which is particularly of significance in case the machine stand is essentially a welded, box-shaped structure.

It is of particular advantage if, in case of the last-named arrangement in which the straightening device has a beyond-critical support, the support block of the wire straightening device is provided with a blocking mechanism with which a rigid connection between the support block and the machine stand can be effected. Thus, in case the support block, together with the wire straightening device is, during the starting phase, rigidly connected with the machine stand, the resonance rpm can be reached and exceeded without disturbing or harmful vibrations. Only after the apparatus has reached its normal operational rpm is the blocking mechanism released to then connect the support block with the machine stand only by means of the elastic element.

In accordance with still another feature of the invention, the straightening motor is mounted on hydrostatically or hydrodynamically operating bearings for further suppressing the generation of operational noises. The oil film between the shaft stubs of the straightening rotor, on the one hand, and the associated bearing shells, on the other hand, has a significant damping effect and thus additionally prevents the transmission of noise-causing vibrations to the machine stand.

According to a further feature of the invention, one roller of the inlet and/or the outlet roller pair is supported stationarily while the associated counter-roller is mounted on a hydraulic piston for displacement in a direction transverse to the wire advance. The hydraulic piston is connected with a device for controlling the hydraulic pressure exerted on the piston. In this manner, in addition to the synchronization of the inlet roller pair and the outlet roller pair by means of the constant-volume hydraulic motors as provided according to the invention, there can be ensured, by controlling the pressing force, an entirely slip-free run of the wire passing through the wire straightening apparatus. While in principle it is feasible to regulate the pressing force purely by mechanical means, for example, by a linkage system with associated weights, a hydraulic control of the pressing force for the wire straightening apparatus is advantageous, if only because the necessary pressurized hydraulic medium is in any event available for use in the hydraulic motors.

In accordance with a particularly advantageous further feature of the invention, the machine stand is so designed that at least one part thereof forms a reservoir for the oil needed for operating the hydraulic motors and further, the reservoir accommodates at least one oil pump and its drive motor. Since the oil pump and its drive motor are completely surrounded by the oil, the appreciable noise of the oil pump is dampened to a significant extent. It is further of advantage to pass the hydraulic oil through a cooling device arranged at the outside of the machine stand and expediently provide it with a thermostatic control.

In accordance with a further feature of the invention, the inner wall of the reservoir is lined with a foam plastic for further reducing the noise emission from the entire apparatus. Advantageously, the thickness of the foam plastic layer is greater than 1/16th of the wave length of the sound to be dampened. it has been found to be particularly advantageous and economical both as far as the material and its installation is concerned, to use polystyrene as the foam plastic layer which on its inwardly oriented free surface is covered by a polyethylene foil. The polyethylene foil can be deposited in the inner space of the reservoir as a sealed (and thus completely fluidtight) bag. The polystyrene layer takes over the function of noise dampening, while the polyethylene foil protects the polystyrene from the chemical effects of the hydraulic oil. In addition, it is further feasible to use sound absorbing foils for dampening critical frequency ranges which escape the polystyrene foam layer.

BRIEF DESCRIPTION OF THE DRAWINGS

FIG. 4 is a schematic top plan view of the embodiment shown in FIG. 3.

FIGS. 5*a* and 5*b* are schematic sectional views of a reservoir forming a component of the embodiments.

DETAILED DESCRIPTION OF THE PREFERRED EMBODIMENTS

Figure 1:
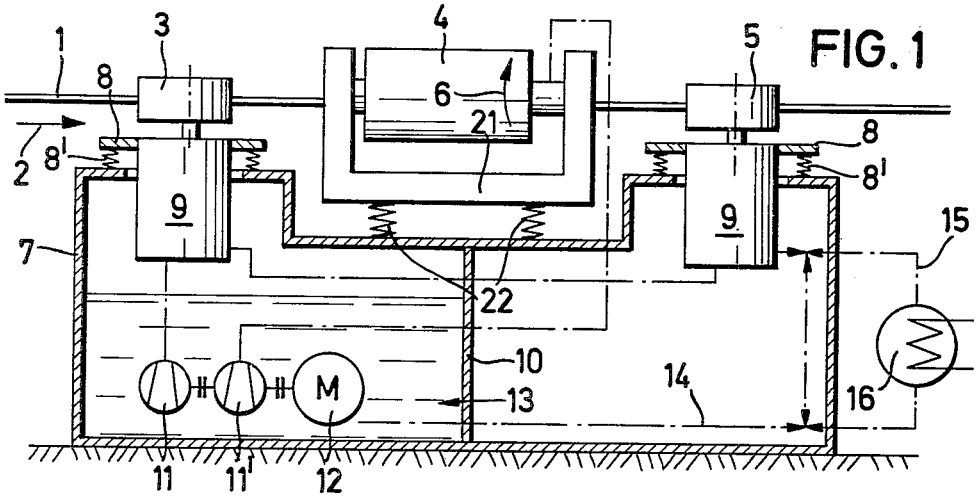
FIG. 1 is a schematic side elevational view, partially in section, of a preferred embodiment of the invention.
Figure 2:
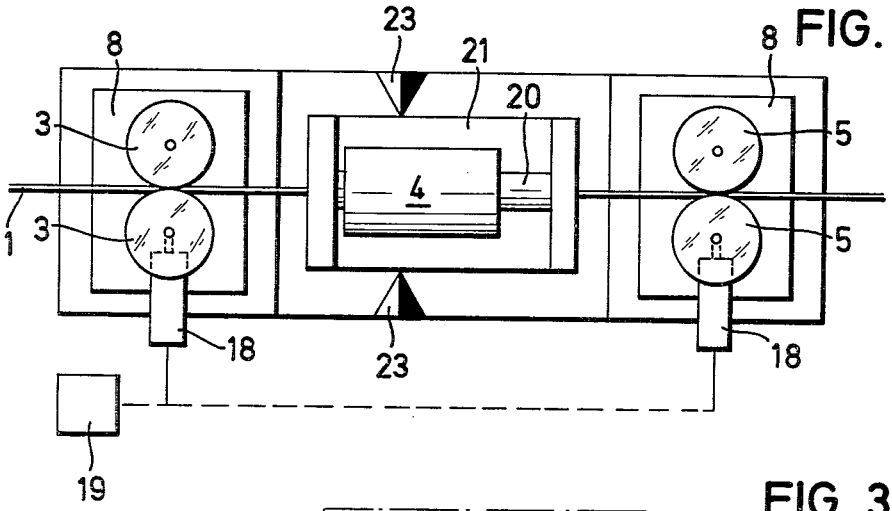
FIG. 2 is a schematic top plan view of the same embodiment.

Turning now to FIGS. 1 and 2 illustrating a preferred embodiment of the invention, there are shown an inlet roller pair 3 and an outlet roller pair 5 for advancing the wire 1 through a wire straightening device 4. The wire straightening device 4 comprises, for example, a rotor driven about its longitudinal axis in the direction of the arrow 6. The rotor supports a plurality of straightening dies which are adjustable transversely to the axis of rotation and which cause the throughgoing wire to follow a meandering course. Straightening devices of this type are known and are therefore not described in detail.

The inlet roller pair 3, the wire straightening device 4, together with its drive as well as the outlet roller pair 5 are supported on a machine stand 7 in such a manner that the axes of rotation of the two roller pairs 3 and 5 are oriented vertically, whereas the axis of rotation of the straightening device 4 is oriented horizontally.

The machine stand is of box-like structure and is provided, in the zone of the two roller pairs 3 and 5 with respective support blocks 8 which are preferably resiliently secured to the machine stand. On each support block 8, there are mounted the respective drive motors 9 for the intake roller pair 3 and the outlet roller pair 5. The support blocks 8 are mounted on the machine stand by resilient elements 8' such as metal springs. The spring constant of these elements is so selected that, with regard to the expected oscillating frequencies, there is achieved a "beyond-critical" tuning when the apparatus operates with the normal rpm's.

The wire straightening device 4 is, together with its schematically shown drive motor 20, mounted on its own support bracket 21. The latter too, is secured by means of elastic elements 22 to the machine stand with "beyond-critical" tuning. By means of a blocking mechanism shown only symbolically at 23, a rigid connection can be provided between the support bracket 21 of the wire straightening device 4 and the machine frame. Thus, during the start-up phase, the elastic connection between the support bracket 21 and the machine stand 7 is temporarily rendered ineffective.

The drive motors 9 as well as the drive motor 20 are constant-volume hydraulic motors of gear pump structure, and are preferably of the "gerotor-motor" type or the "orbit-motor" type.

Figure 6A:
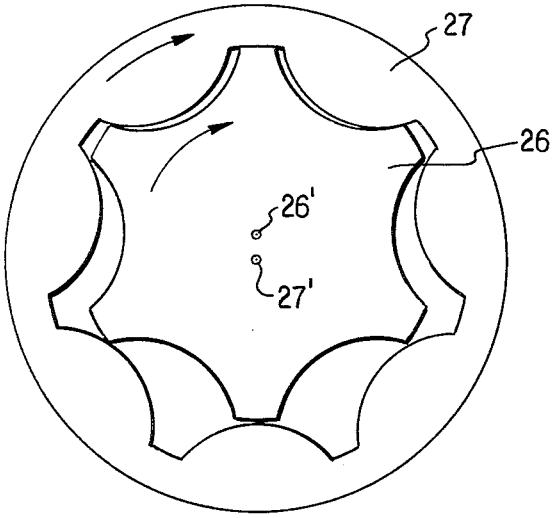
FIGS. 6*a* and 6*b* are schematic plan views showing the operational principle of hydraulic drive motors preferably incorporated in the embodiments shown in FIGS. 1–3.

The operational principle of a "gerotor-motor" is shown in FIG. 6*a*. The motor comprises, in a housing (not shown), a gear wheel 26, which is eccentrically arranged with respect to and meshes with an annular toothed wheel 27. The wheels 26 and 27 rotate within the housing about their respective axes 26' and 27' as they are driven by a stream of hydraulic fluid under pressure.

Figure 6B:
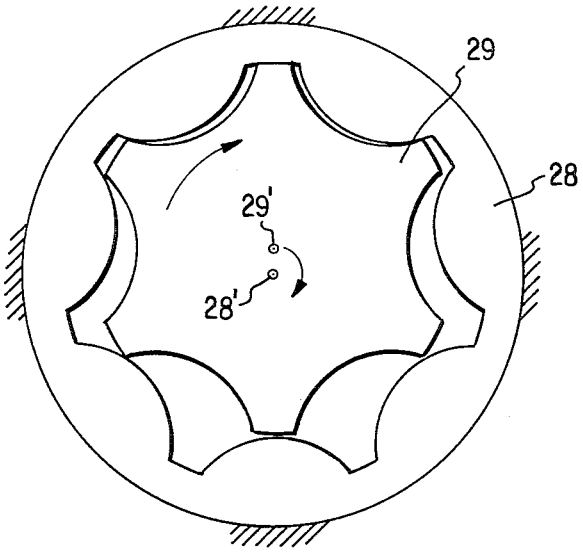

The operational principle of an "orbit-motor" is shown in FIG. 6*b*. The motor comprises an annular toothed ring 28 rigidly mounted in a housing (not shown). A gear wheel 29 is mounted rotatably within the ring 28 and meshes therewith. The gear wheel 29 rotates about its own axis 29' and additionally orbits in a superposed motion about the axis 28' of the toothed ring 28. The gear wheel 29 is driven by a stream of hydraulic fluid under pressure, which is controlled by a synchronous rotating commutator valve (not shown).

While both types of motors described above in connection with FIGS. 6*a* and 6*b* are known by themselves, they form part of the invention in so far as their application in the new wire straightening apparatus is concerned. Dependent upon the magnitude of the torque to be applied for advancing the wire, one or both rollers of each roller pair are coupled to the associated hydraulic motor 9. The hydraulic motors 9 are directly flanged to the respective support block 8 at their frontal bearing cover so that the rollers 3 and 5 are floatingly secured to the drive shafts of their respective hydraulic motor 9. In each roller pair one roller is stationarily supported on the associated bearing block, whereas the respective counter-roller is shiftable on the support block 8 transversely to the direction of wire advance and is mounted, for this purpose, on a respective hydraulic piston 18. The two hydraulic pistons 18 associated with the one and the other roller pair are connected to a hydraulic control 19 for setting the oil pressure and thus regulating the pressing force applied to the wire passing between the rollers of the respective roller pairs.

The machine stand 7 is a welded box-like structure which simulataneously serves as a reservoir for the hydraulic oil. The machine stand is either in its entirety shaped as the reservoir (FIG. 3) or the latter is defined only by one part of the machine stand. Thus, as shown in FIG. 1, dependent upon the size of the stand, a dividing wall 10 may delimit the reservoir. In this manner, only the left half of the stand serves as the reservoir for the hydraulic liquid.

Figure 3:
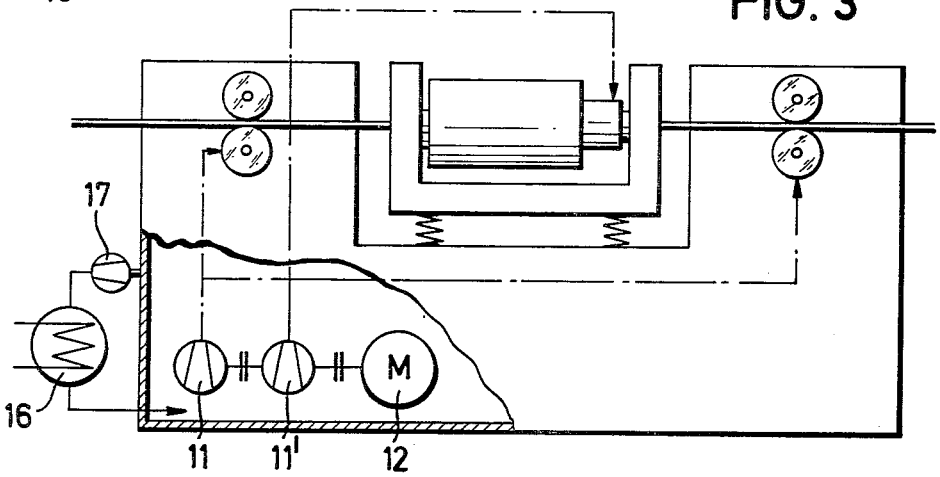
FIG. 3 is a schematic, partially broken-away, side elevational view of another preferred embodiment of the invention.

The hydraulic motors 9 are connected to an oil pump 11 which, together with its drive motor 12, which may be a submersible electromotor, is submerged in the hydraulic liquid 13 and is supported by the machine stand. In the embodiment illustrated in FIG. 1, the respective hydraulic motors 9 of the inlet roller pair 3 and the outlet roller pair 5 are connected in series to thus achieve a positive synchronous run. Because of the particularly favorable operational conditions involved in motors of this type, it is feasible to connect the motors in parallel as shown in FIG. 3. The hydraulic motor 20 which serves the straightening device 4 is, because of its higher rpm, supplied with hydraulic medium by its own, separate oil pump 11'. It is noted that the straightening motor is driven at approximately 1000–15000 rpm, whereas the speed of the rollers in the roller pairs is approximately 100–500 rpm. For this reason, the pumps 11 and 11' are separately controllable in a conventional manner. In the series connection illustrated in FIG. 1, the return conduit 14 extending from the hydraulic motor (or motors) 9 opens into the reservoir 13. For cooling the hydraulic medium, there is provided a bypass conduit 15 which controls, for example, thermostatically, the entire oil flow or only part thereof and directs the oil through a cooler 16 to ensure that a generally constant temperature of the oil 13 is maintained. Dependent upon the dimension of the wire straightening apparatus, it may be sufficient for oil cooling purposes to merely provide with external cooling fins that portion of the machine stand which defines the reservoir. Similarly, it is feasible to connect the oil cooler with an oil circuit provided with its own auxiliary pump 17 as shown in FIG. 3. In this embodiment which also may be equipped with a thermostat control, the entire oil bath can be maintained at approximately constant temperatures and thus, in particular, a sufficient cooling of the oil pump 11 and its drive motor 12 is ensured.

The embodiment illustrated in FIGS. 3 and 4 is in principle of the same construction as that shown in FIGS. 1 and 2. In addition to the differences discussed earlier, the embodiment according to FIG. 3 differs from that according to FIGS. 1 and 2 essentially in that in the second embodiment the rollers of the inlet and outlet roller pairs are of horizontal orientation, so that a significant reduction in the depth of the entire apparatus is achieved.

FIG. 5*a* schematically illustrates the cross section of a machine stand frame 7 serving simultaneously as a reservoir. Its inner wall is lined with a foam plastic layer 24 to achieve an improved sound insulation. Since, as a rule, such a plastic layer is secured in form of plates or the like to the inner wall of the reservoir and thus does not have a fluidtight face, it is expedient to cover the inwardly oriented free face of the layer 24 with an oil-tight plastic foil such as a polyethylene foil, as shown on an enlarged scale in the fragmentary FIG. 5*b*. This foil may be formed, for example, as a welded bag conforming to the shape of the inside of the reservoir. When an oil-tight bag of this type is installed in the reservoir, the layer 24 may be, for example, polystyrene foam.

It will be understood that the above description of the present invention is susceptible to various modifications, changes and adaptations, and the same are intended to be comprehended within the meaning and range of equivalents of the appended claims.

What is claimed is:

1. In a wire straightening apparatus including a machine stand; a wire straightening device; mounting means for securing the wire straightening device to the stand; an inlet roller pair and an outlet roller pair; mounting means for securing the inlet roller pair and the outlet roller pair to the stand adjacent opposite sides of the wire straightening device for feeding a wire therethrough; and drive means for rotating the roller pairs; the improvement wherein said drive means comprises a first constant-volume hydraulic motor connected to at least one of the rollers of said inlet roller pair; a second constant-volume hydraulic motor connected to at least one of the rollers of said outlet roller pair; and means supplying hydraulic medium under pressure to said motors; further wherein said mounting means for said inlet roller pair, said outlet roller pair and said wire straightening device comprises separate support blocks each connected to said stand by respective resilient means; the improvement further comprising a blocking mechanism operatively connected to said wire straightening device; said blocking mechanism having an actuated state in which it rigidly connects said wire straightening device with said stand.

2. In a wire straightening apparatus including a machine stand; a wire straightening device; mounting means for securing the wire straightening device to the stand; an inlet roller pair and an outlet roller pair; mounting means for securing the inlet roller pair and the outlet roller pair to the stand adjacent opposite sides of the wire straightening device for feeding a wire therethrough; and drive means for rotating the roller pairs; the improvement wherein said drive means comprises (a) a first constant-volume hydraulic motor connected to at least one of the rollers of said inlet roller pair;

(b) a second constant-volume hydraulic motor connected to at least one of the rollers of said outlet roller pair; and (c) means supplying hydraulic medium under pressure to said motors, including (1) a reservoir constituted by at least one part of said stand and having an inner wall lined with a foam plastic layer;

(2) a pump for supplying hydraulic medium from said reservoir to said motors; and (3) a pump drive motor connected to said pump; said pump and said pump drive motor being disposed within said reservoir.

3. A wire straightening apparatus as defined in claim 2, wherein said foam plastic layer is polystyrene; further comprising a polyethylene foil on the inwardly oriented surface of said foam plastic layer.

4. A wire straightening apparatus as defined in claim 1 or 2, wherein each said motor has a drive shaft and wherein the driven roller of each said roller pair is directly mounted on the drive shaft of the respective motor.

5. A wire straightening apparatus as defined in claim 1 or 2, further comprising a third constant-volume hydraulic motor driving said wire straightening device and means supplying hydraulic medium to the third motor.

6. A wire straightening apparatus as defined in claim 1, wherein at least one of said motors is of the gerotor-motor type.

7. A wire straightening apparatus as defined in claim 1, wherein at least one of said motors is of the orbit-motor type.

8. A wire straightening apparatus as defined in claim 1 or 2, wherein said wire straightening device has a straightening rotor supported by hydrostatic bearings.

9. A wire straightening apparatus as defined in claim 1 or 2, wherein said wire straightening device has a straightening rotor supported by hydrodynamic bearings.

10. A wire straightening apparatus as defined in claim 1 or 2, wherein one roller of at least one of said roller pairs is stationarily supported on the respective mounting means; further comprising a hydraulic piston carrying the other roller of said at least one roller pair for displacing said other roller transversely to the direction of the wire feed and control means connected to the piston for regulating the hydraulic pressure exerted thereon.

* * * * *